US007028838B1

(12) United States Patent
Rhoades

(10) Patent No.: US 7,028,838 B1
(45) Date of Patent: Apr. 18, 2006

(54) LIGHT STRAND STORAGE DEVICE

(76) Inventor: Judith A. Rhoades, 30924 Rosslyn, Garden City, MI (US) 48135

( * ) Notice: Subject to any disclaimer, the term of this patent is extended or adjusted under 35 U.S.C. 154(b) by 26 days.

(21) Appl. No.: 10/739,976

(22) Filed: Dec. 19, 2003

(51) Int. Cl.
*B65D 85/42* (2006.01)

(52) U.S. Cl. ..... 206/419; 206/420; 206/483; 206/495; 206/480

(58) Field of Classification Search ..... 206/419, 206/420, 421, 422, 480, 483, 388, 495, 702; 211/26, 26.2; 362/249
See application file for complete search history.

(56) References Cited

U.S. PATENT DOCUMENTS 897,173 A * 8/1908 Strassberger ..... 242/222
3,664,719 A * 5/1972 Berg ..... 312/185
4,258,843 A * 3/1981 Wymer ..... 206/63.3
4,878,586 A * 11/1989 Bancroft et al. ..... 211/106
5,033,619 A 7/1991 Garis
5,168,999 A * 12/1992 Lee et al. ..... 206/420
D347,989 S 6/1994 DeWard
5,653,339 A 8/1997 Dobson
5,907,945 A 6/1999 Doyle
5,941,388 A * 8/1999 Spielberger ..... 206/419
6,009,688 A 1/2000 Pedersen et al.
6,142,405 A * 11/2000 Black ..... 242/388.6
6,450,339 B1 9/2002 Ashton

* cited by examiner

*Primary Examiner*—David T. Fidel

(57) ABSTRACT

A light strand storage device includes a panel having a first side, a second side and a peripheral edge. The peripheral edge includes a first edge, a second edge, a third edge and a fourth edge wherein the first and second edges are positioned opposite of each other. Each of the third and fourth edges has an indentation therein. The indentations are positioned nearer the first edge than the second edge and are positioned generally opposite of each other. Each of a plurality of securing members is attached to and extends outwardly away from the first and second sides. A light string may be extended around the panel and secured to the panel by the securing members.

6 Claims, 5 Drawing Sheets

LIGHT STRAND STORAGE DEVICE

BACKGROUND OF THE INVENTION

1. Field of the Invention

The present invention relates to light storage devices and more particularly pertains to a new light storage device for storing a light strand having a plurality of interconnected light strands.

2. Description of the Prior Art

The use of light storage devices is known in the prior art. While these devices fulfill their respective, particular objectives and requirements, the need remains for a device for organizing and storing new light strands which are created to resemble icicles hanging from a roof. Such light strands include an elongated primary body, or electrical cord, and a plurality of light strands extending away from the primary body. A device is needed that not only prevents the entangling of the primary body but also the light strands which extend away therefrom.

SUMMARY OF THE INVENTION

The present invention meets the needs presented above by generally comprising a panel having a first side, a second side and a peripheral edge. The peripheral edge includes a first edge, a second edge, a third edge and a fourth edge wherein the first and second edges are positioned opposite of each other. Each of the third and fourth edges has an indentation therein. The indentations are positioned nearer the first edge than the second edge and are positioned generally opposite of each other. Each of a plurality of securing members is attached to and extends outwardly away from the first and second sides. A light string may be extended around the panel and secured to the panel by the securing members.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

The objects of the invention, along with the various features of novelty which characterize the invention, are pointed out with particularity in the claims annexed to and forming a part of this disclosure.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
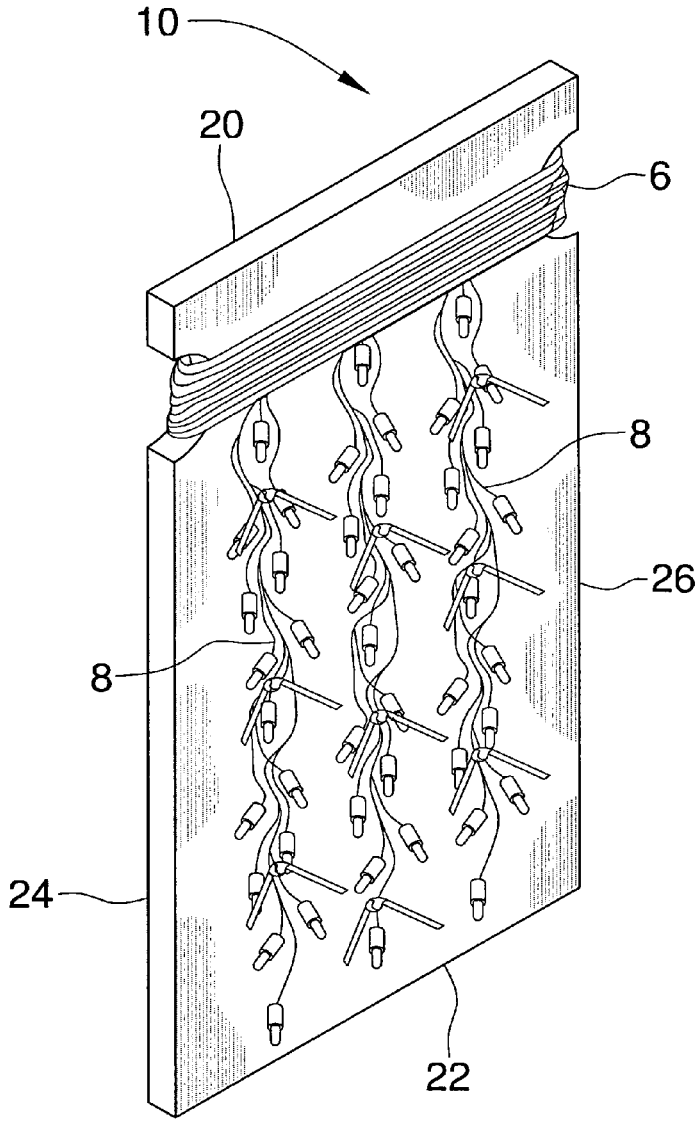
FIG. 1 is a schematic perspective view of a light strand storage device according to the present invention.

With reference now to the drawings, and in particular to FIGS. 1 through 5 thereof, a new light storage device embodying the principles and concepts of the present invention and generally designated by the reference numeral 10 will be described.

As best illustrated in FIGS. 1 through 5, the light strand storage device 10 generally comprises a panel 12 having a first side 14, a second side 16 and a peripheral edge 18. The peripheral edge 18 includes a first edge 20, a second edge 22, a third edge 24 and a fourth edge 26 wherein the first 20 and second 22 edges are positioned opposite of each other. Each of the third 24 and fourth 26 edges has an indentation 28 therein. The indentations 28 are positioned nearer the first edge 20 than the second edge 22 and are positioned generally opposite of each other. Each of the indentations 28 has an arcuate shape. The panel 12 has a length from the third edge 24 to the fourth edge 26 generally between 12 inches and 16 inches and a height from the first edge 20 to the second edge 22 generally between 20 inches and 30 inches. The panel 12 is preferably comprises either a cardboard material or plastic material.

A plurality of securing members 30 is attached to and extends outwardly away from the first 14 and second 16 sides. The securing members 30 are preferably aligned in rows extending from the first edge 20 to the second edge 22. The securing members 30 are positioned between a line extending through the indentations 28 and the second edge 22. Each of the securing members 30 includes a pair of flexible members 32 positioned generally adjacent to each other. The flexible members 32 each have a first end 34 and a second end 36. The flexible members 32 extend through the panel 12 such that each of the first ends 34 extends away from the first side 14 and each of the second ends 36 extends away from the second side 16. The flexible members 32 each preferably comprise a metallic wire having either a plastic or elastomeric coating thereon.

Figure 2:
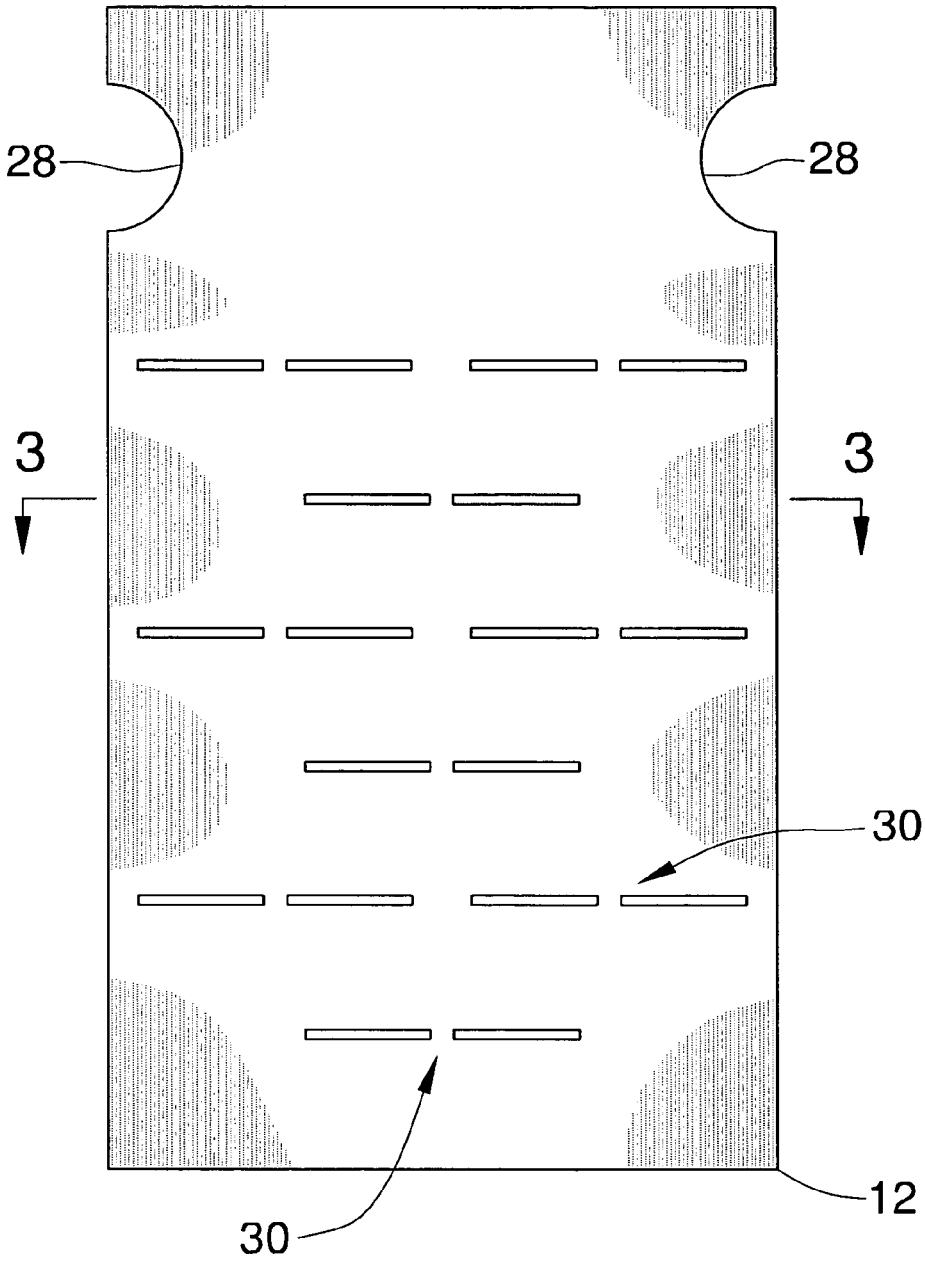
FIG. 2 is a schematic front view of the present invention.
Figure 3:
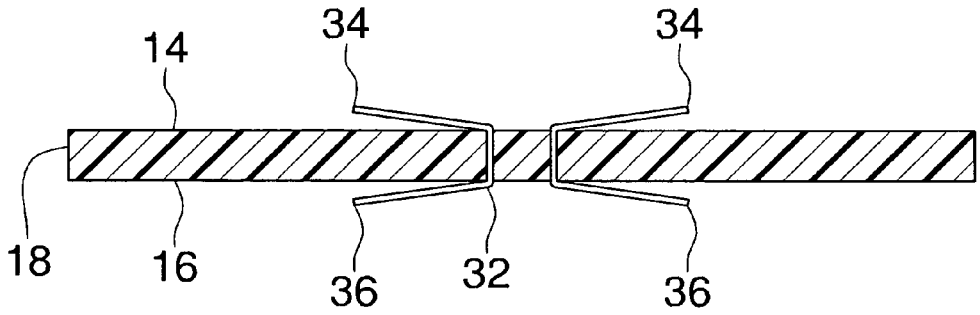
FIG. 3 is a schematic cross-sectional view taken along line 3—3 of FIG. 2 of the present invention.
Figure 4:
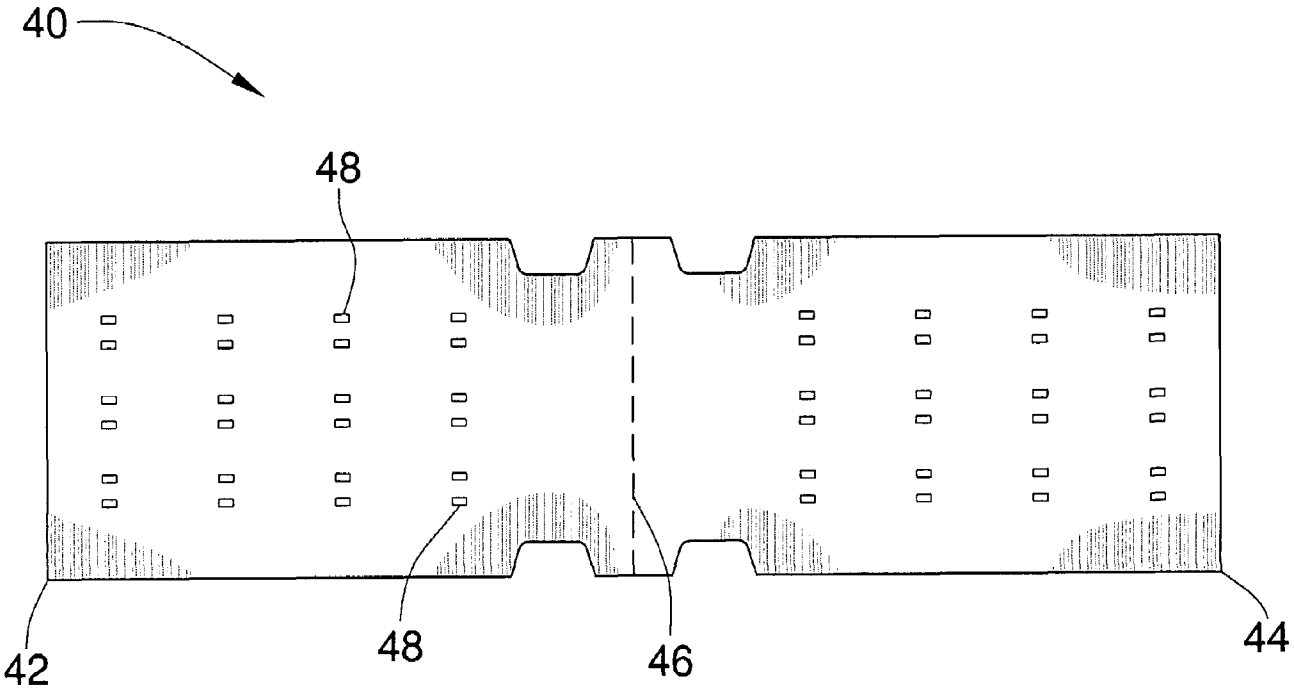
FIG. 4 is a schematic front view of a second embodiment of the present invention.
Figure 5:
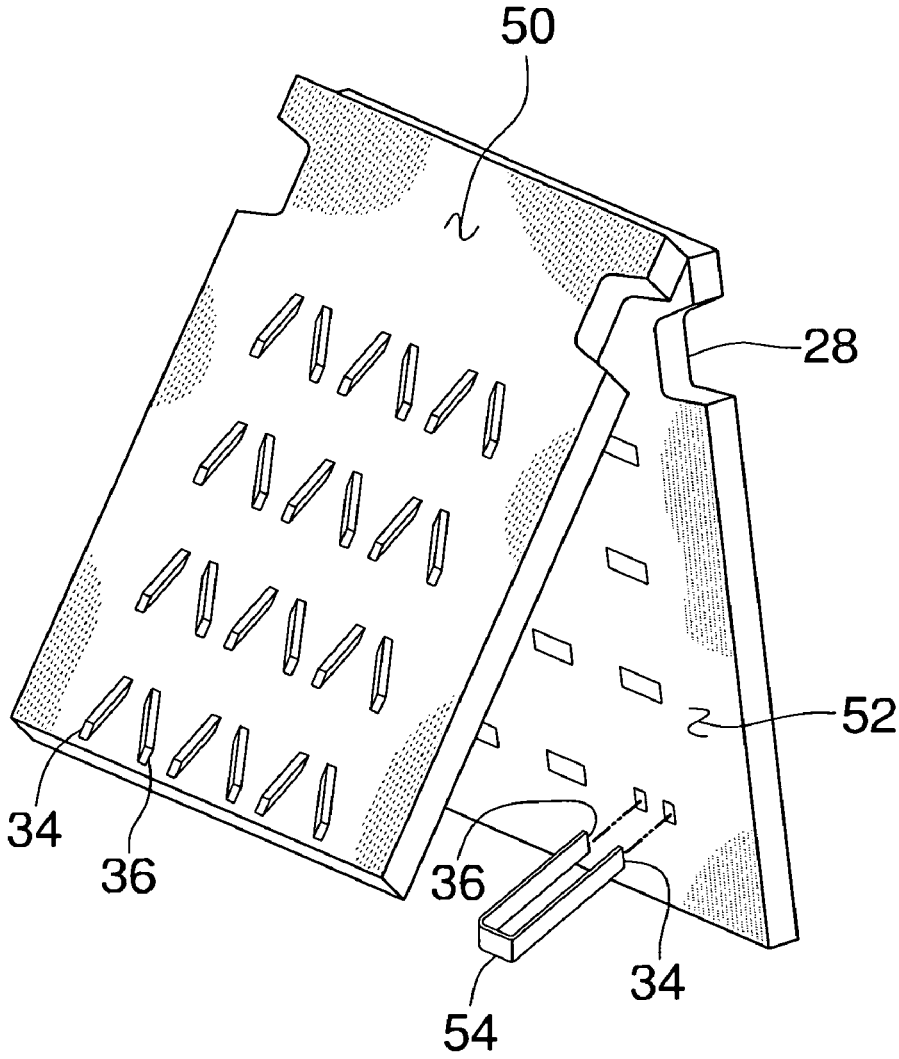
FIG. 5 is a schematic front view of a second embodiment of the present invention.

A second embodiment 40 of the panel is shown in FIG. 4 and includes a pair of panels 42, 44 attached together along a fold line 46. This embodiment includes a plurality of apertures 48 through which the flexible members 32 may be extended. The pair of panels 42, 44 is folded to form the shape as shown in FIG. 2. The flexible members 32 are extended through the apertures 48 so that both the first 34 and second 36 ends extend away from a first side 50 and a central portion 54 of the flexible members 32 abut a second side 52 so that when the panels 42, 44 are folded together the flexible members 32 are held in place.

In use, the main body 6 of a string of lights is extended around the panel 12 as shown in FIG. 1 such that it is positioned in the indentations 28. Stands of lights 8 extending from the main body 6 are run across adjacent first 20 and second sides 22 of the panel 12 such that the securing members 30 may be used to secure them to the panel 12. This ensures that the strands of lights 8 extending away from the main body 6 do not become entangled with each other or the main body 6.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A light string organizing and storage device, said device comprising:

a panel having a first side, a second side and a peripheral edge, said peripheral edge including a first edge, a second edge, a third edge and a fourth edge wherein said first and second edges are positioned opposite of each other, each of said third and fourth edges having one indentation therein, each said indentation being positioned nearer said first edge than said second edge, said indentations being positioned generally opposite of each other;

a plurality of securing members being attached to said panel and extending through said first and second sides and in generally opposite directions with respect to said panel, said securing members being generally aligned in a plurality of rows extending from said first edge to said second edge, each of said rows having at least two of said securing members positioned therein; and wherein the light string may be extended around said panel and secured to said panel by said securing members.

2. The device of claim 1, wherein each of said indentations has an arcuate shape.

3. The device of claim 1, wherein said panel has a length from said third edge to said fourth edge generally between 12 inches and 16 inches, said panel having a height from said first edge to said second edge generally between 20 inches and 30 inches.

4. The device of claim 1, wherein said securing members are positioned between a line extending through said indentations and said second edge.

5. The device of claim 1, wherein each of said securing members include a pair of flexible members positioned generally adjacent to each other, each of said flexible members having a first end and a second end, each of said flexible members extending through said panel, each of said first ends being adjacent to and extending away from said first side and each of said second ends being adjacent to and extending away from said second side.

6. The device of claim 4, wherein each of said securing members include a pair of flexible members positioned generally adjacent to each other, each of said flexible members having a first end and a second end, each of said flexible members extending through said panel, each of said first ends being adjacent to and extending away from said first side and each of said second ends being adjacent to and extending away from said second side.

* * * * *